US006212799B1

(12) United States Patent
Gingerich et al.

(10) Patent No.: US 6,212,799 B1
(45) Date of Patent: Apr. 10, 2001

(54) ROTARY DRIVE CONTAINED WITHIN HOLLOW ROTATING DRUM

(75) Inventors: Newton Roy Gingerich, Baden; Anthony Asquith, Waterloo, both of (CA)

(73) Assignee: Electric Tractor Corporation, Cambridge (CA)

( * ) Notice: Subject to any disclaimer, the term of this patent is extended or adjusted under 35 U.S.C. 154(b) by 0 days.

(21) Appl. No.: 09/308,260

(22) PCT Filed: Sep. 15, 1998

(86) PCT No.: PCT/CA98/00882

§ 371 Date: May 14, 1999

§ 102(e) Date: May 14, 1999

(87) PCT Pub. No.: WO99/14439

PCT Pub. Date: Mar. 25, 1999

(30) Foreign Application Priority Data

Sep. 15, 1997 (CA) ..... 2215457
Dec. 16, 1997 (GB) ..... 9726498

(51) Int. Cl.[7] ..... E01H 5/04
(52) U.S. Cl. ..... 37/246
(58) Field of Search ..... 37/244, 246, 248; 320/61, 63; 180/65.6, 65.1, 65.5, 291, 292, 6.48, 6.5, 2.2

(56) References Cited

U.S. PATENT DOCUMENTS 4,329,792 * 5/1982 Berner ..... 37/246
5,743,347 * 4/1998 Gingerich ..... 180/65.1
6,035,561 * 3/2000 Paytas et al. ..... 37/246

FOREIGN PATENT DOCUMENTS 526 008 * 9/1972 (CH) ..... E01H/5/09
87 00 798 U * 4/1987 (DE) ..... E01H/1/02
87 14 776 U * 3/1988 (DE) ..... F41H/11/16

* cited by examiner

*Primary Examiner*—Robert E. Pezzuto
(74) *Attorney, Agent, or Firm*—Anthony Asquith & Co.

(57) ABSTRACT

A single-stage snowblower (20) is designed as an accessory for attachment to an electric tractor, and takes power from the batteries on the tractor. The rotary drum (24) of the snowblower, which carries the spiral blade (25), is driven by two electric motors (36L, 36R). The motors lie inside the hollow interior of the drum (24), and drive the drum directly, without chains or gears. The drum (24) has no bearings other than the motor bearings provided inside the motor housing. The ends of the motors are fixed to the snowblower housing. Walk behind versions of the snowblower are also disclosed. In a different version an anti-personnel-mine clearing flail-drum (74) is pushed ahead of an electric tractor (72) by forward-extending struts. The flail-drum is rotated by motors located inside the drum. Other appliances can make up a train of appliances, ahead of the tractor. An under-growth cutter (90), for example, can be mounted ahead of the flail-drum, and can be carried just clear of the ground, its weight being transferred, via the struts, to the flail-drum.

26 Claims, 14 Drawing Sheets

ROTARY DRIVE CONTAINED WITHIN HOLLOW ROTATING DRUM

This invention relates to rotary apparatus. One example of such apparatus, to which the invention can be applied, is a snowblower of the kind in which a drum having an auger or spiral blade is supplied with rotary power. The drum gathers snow in at an open mouth of the apparatus, and trajects the snow to a discharge chute with enough energy that the snow is blown away from the apparatus. Snowblowers can be non-driven, whereby the snowblower has to be pushed along the ground, e.g by a person walking behind, or by a tractor; or the snowblower can be equipped with power means for driving the snowblower along the ground.

The invention is applicable also to other rotary machines and apparatus, as will be described.

BACKGROUND TO THE INVENTION

Gasoline-powered snowblowers are conventional, and well known. However, powering snowblowers by means of an electric motor, though not unknown, is not common. Electricity has not been accepted as a favoured means for driving the drum of a snowblower. The power required for a conventional snowblower configuration can be easily supplied from a small gasoline engine, whereas drawing that much power from electric batteries can require an inconveniently large outlay in batteries. Supplying that much power from the electric mains via an extension cord would not be convenient either.

On the other hand, electric power is favoured no less for snowblowers than for other appliances, for the usual benefits of electric power, i.e simplicity of structure, ruggedness, lack of service problems, quietness of running, efficiency, and so on.

The invention is aimed at enabling the benefits of electric power to be realised in a category of cases where electric power was hitherto considered inappropriate.

GENERAL FEATURES OF THE INVENTION

A rotary apparatus that embodies the invention preferably includes a rotary drum. The drum is configured as a hollow cylindrical tube. The motor lies at least partly inside the drum. Preferably, the configuration of the apparatus is such that, in an end-view of the apparatus, the drum totally circumscribes the whole structure of the motor (i.e circumscribes the housing or outer casing of the motor) in the radial sense. Preferably, also in the axial sense, the motor lies at least partly contained within the ends of the hollow interior of the drum.

The drum is drive-coupled to the rotor of the motor, and preferably the drum is driven to rotate by the motor-shaft in direct unison with the motor-shaft—direct unison, that is to say, in the sense that there are no chain-drives, gearboxes, or the like between the motor shaft and the drum.

The invention would not be applicable in such a case as a winch, for example, in which a as drum is driven by a motor, but in which a large or very large gear-ratio is applied between the motor-shaft and the drum.

The invention is advantageous when applied to rotary machines in which the functional rotating structure can be built upon a rotating drum. That is to say, in which the functional rotating structure can use the rotating drum mechanically, as a structural mounting platform. Thus, the snowblower appliance has converging spiral augers built upon a drum; a rotary broom appliance has brush-bristles built upon a drum; and an anti-personnel-land-mine clearing appliance has chains or the like built upon a drum, which flail the ground when the drum is rotated.

As will be described, the invention is further advantageous when applied to the category of rotary machine in which the functional elements of the rotary apparatus are disposed axially along the length of a drum. The invention especially favours the category of rotary machine in which the functional rotary elements of the machine are disposed in a more or less even distribution along the length of the drum, especially when the drum has considerable axial length. Again, it will be appreciated that the snowblower, broom, and mine-clearing appliances fall into this category.

The invention is advantageous when applied to rotary machines in which the speed desired of the functional rotating structure, i.e when the speed at which the rotating structure itself must rotate in order to perform its function, is matchable with the rotational speed of the motor. In the case of a winch or crane, as mentioned, the apparatus cannot function unless the drum is at a large gear-ratio relative to the motor shaft.

It is not necessary, in the invention, that the drum and the motor must rotate at a constant speed during operation. However, the invention is advantageously applicable in such cases. The invention is especially advantageous in those cases in which, if the load on the drum should vary, the designer seeks to vary the torque produced by the motor in order to maintain the drum at constant speed. This is a usual desideratum in machines such as snowblowers, brooms and mine-clearing apparatus.

The invention is not applicable when the rotary machine includes nothing like a hollow cylinder or drum having axial length—for example, most rotary pumps include nothing like a long hollow drum. Furthermore, there would be no functional advantage arising from configuring the rotor of a pump in the form of a hollow rotary drum. However, if a certain type of pump could be advantageously configured as a rotating drum, the invention might be applicable to that.

The invention is mainly applicable to rotary machines in which the rotor has (or can be adapted to have) the form of a hollow cylindrical drum, and the functional rotary structure of the machine is (or can be adapted to be) mechanically mounted on the outside of, and along the length of, the cylindrical drum The rotary component of a machine that embodies the invention has been referred to as a hollow drum. It should not be construed as a limitation of the invention that the hollow drum must be right-cylindrical; however, in the machines described herein, the drums are right-cylindrical. (A right-cylinder is a cylinder of regular shape and having a constant diameter along its length.)

For the invention to be advantageous in a particular case, the motor has to be right shape. That is to say, the motor should be of complementary shape to the drum, whereby the motor can fit inside the drum. Thus, the motor should be drum shaped, i.e its shape should be characterised as a compact cylinder having axial length. Electric motors generally have this shape. Hydraulic motors also either have this shape, or can be configured in this shape. One type of prime mover that really does not lend itself to being configured to the sort of shape that would fit inside a hollow rotating drum is, of course, the internal combustion engine.

The mechanically-simple configuration of motor to which the invention mainly applies may be distinguished from a gasoline engine, in which the engine block itself is but one a component of many which are needed to complete the drive function, including fuel tank, exhaust system, clutch and gearbox, etc, etc.

The invention is described herein as it relates to electric drive-motors, but, as mentioned, some of the benefits of the invention apply also with other rotary prime movers, such as hydraulic drive-motors. The invention is applicable when the motor is configured basically as a solid, compact, cylindrical structure, the energy for the motor being supplied (from an energy source, such as a battery, mounted on the non-rotating part of the apparatus) via a simple wire or pipe. The invention is aimed at making it possible to apply such drive motors, with their many benefits, in the context of such rotary apparatus as snowblowers and the like.

In one form, the rotary apparatus is intended for use as an accessory to an electric tractor, to which the apparatus is hitched, and upon which the batteries needed to power the apparatus are carried. A vertical-engagement hitching system of the kind described in the patent publication WO-94/21106 (GINGERICH, September 1994) is then preferred. The invention can also be applied in the case where the rotary apparatus is self-contained, for example in a push-along or walk-behind arrangement, the batteries (or other power source) then being carried on a non-rotary frame of the apparatus.

The benefits of the invention arise mainly when the invention is applied to rotary machines that are, or are attached to, moving vehicles. However, the invention can be applied to stationary rotary machines.

The invention is advantageously applicable when the functional rotating element is a structure that engages the ground, but which also rotates relative to the ground (as is the case with the snowblower, broom, and mine-clearer). In these cases, the functional rotating element does not roll over the ground, in the sense that a wheel rolls over the ground, but rather the element, in rotating, brushes the ground. In the case of elements that roll over the ground, the speed-torque characteristics generally are found to be difficult to match to the speed-torque characteristics of a suitable motor, whereby direct-drive would be ineffectual, and therefore most of the advantages of the invention would be unavailable.

The preference for the functional rotating element to brush the ground rather than roll over the ground does not necessarily mean that wheels or some other structure must be provided to support the weight of the element relative to the ground. The ground-engaging components can brush the ground, and yet still transmit the element's own weight (and the weight of a load) to the ground through the ground-engaging components. Thus, in the land-mine clearing apparatus, the flails pound the ground, and the reaction to the downwards force thus generated can be used to hold the rotating drum structure well clear of the ground. In other words, only the flails touch the ground, and the system can be designed so that there is no need for any ground-engaging support structure. This is of course a highly desirable characteristic in an apparatus for clearing mines. This same point applies to a rotary broom; however, in the case of a snowblower, the rotating auger of the snowblower usually cannot be allowed to take the weight of the snowblower, and so a snowblower normally needs wheels, or tracks, etc, or at least slippers, to support the weight of the apparatus. Either that, or, in the case where a snowblower is solid-hitched to a tractor, the weight of the snowblower can be supported by the tractor.

The invention is applicable when the torque and speed characteristics produced by the motor can be matched directly to the torque and speed characteristics required by the functional rotating element. As mentioned, the invention loses much of its advantage if the rotor of the motor cannot be drive-coupled directly to the drum. Appliances that rotate at speeds measured in the hundreds of RPM are about right: when speeds are less (e.g as in winches) a gearing ratio is required; there is no real upper limit to speed, except that sizeable drums that rotate at speeds in excess of a few hundred RPM start to have other design difficulties.

The invention is mainly suitable for rugged, not particularly fast, drives, e.g snowblowers, brooms, and land-mine clearers.

The invention is mainly suitable for use in an apparatus that comprises, or is a component of, a vehicle that is adapted for movement over the ground. Generally, in that case, the apparatus is used for the purpose of manipulating material lying on or in the ground surface.

As to the manner of mounting the motor in the drum, preferably, as will be described, the shaft of the motor is coupled directly to the drum. Preferably, the coupling is done in such a manner that the rotary bearings provided in the motor, for the motor shaft, serve also as the rotary bearings needed by the drum. Thus, no other bearings need be provided. The bearings in the (electric) motor are already housed in a strong, sealed housing, and can easily support the journal and thrust loads imposed by the drum. That is to say, the invention is especially advantageous when applied in those cases where the motor bearings can serve also as the drum bearings.

The non-rotating structure of the motor has to mounted on the non-rotating frame of the apparatus, and has to be constrained against rotation, and has to transmit support forces between the rotary components and the fixed frame. Fixed support for the stator of the motor is, of course, only available outside the drum; and, given that the length of the drum extends continuously, without a break, across a considerable width of the apparatus, access for a support structure for the motor is available only at the axial ends of the drum. In most instances, it is preferred that the motor be supported at both ends of the drum, although (cantilever) support from just one end can be contemplated. Connecting two motors to the drum, one at each end of the shaft, is a convenient and efficient way of utilising the support-access envelope the apparatus.

Preferably, the casing of the electric motor is fixedly mounted to the non-rotary frame of the rotary apparatus. The configuration of the apparatus is such that the hollow-cylindrical drum lies co-axially with respect to the motor-shaft, and the drum is mounted directly to the motor-shaft, whereby the rotary drum is constrained to rotate in direct unison with the motor-shaft of the motor.

The invention is particularly advantageous when the electric motor is controlled as to its speed, under varying loads. Patent publication xxx describes a system for monitoring speed, which uses feedback control to control torque, and thereby to maintain speed at set RPM value.

Applications of the invention to such appliances as described herein are based on the use of low voltage DC, such as can be provided from batteries. Motors can be of the permanent-magnet type, or can be of the series-wound type, etc, for special applications.

It will be understood that the invention is especially applicable in the case where an electric motor is so configured that the casing of the motor is the rotor, and the shaft or armature is the stator. In that case, it is easy for the designer to provide a good solid attachment of the (rotor)

motor-casing to the drum; and just as simple to attach the (stator) shaft to the fixed support structure located at the ends of the drum.

Thus, inverting the motor, i.e making the casing the rotor and the shaft the stator, in the invention, leads to a considerable advantage in terms of arranging the mechanical arrangement of the components. The disadvantage is that motors are not normally made like that, so the motor itself has to be specially designed and manufactured; and the thrifty designer knows that electric motors are only inexpensive insofar as they are made in large quantities.

On the other hand, in applications where the motor can be of the permanent-magnet type, making the casing or housing the rotor and the motor-shaft the stator means that the commutator and brushes are no longer needed. The rotor carries only the permanent magnets (i.e no field windings), and therefore the rotor does not need to be supplied with electricity. This can be a large enough advantage, when considered in addition to the mechanical benefits of inverting the structure of the motor, as to warrant specially designing and manufacturing the motor. The power required for the non-rotating armature can be supplied via solid-state controls.

Furthermore, the structural advantages that arise, in a motor-inside-the-drum installation, from inverting the motor structure, i.e of making the motor-casing the rotor and the motor-shaft the stator, might be so great that the designer wishes to invert the motor even when the motor is of the kind that employs field windings. But, in that case the brushes and commutator (or slip rings) are not eliminated, since those components are now needed to feed power to the rotating field windings. That is to say, the problem of feeding electricity to a rotating component is still present: but now the rotating connection has to be made in respect of the field windings rather than in respect of the armature windings.

A major benefit of the apparatus as described herein is that the motor is tucked away inside the drum. Therefore, the motor is very effectively protected from being damaged, a e.g by debris from snowblowing or sweeping, or of course from mine-clearing. Even if damage does occur, it is likely that the damage would be to the wires (or pipes), which are easily and quickly replaced.

DETAIL DESCRIPTION OF THE DRAWINGS

By way of further explanation of the invention, exemplary embodiments of the invention will now be described with reference to the accompanying drawings, in which.

DETAILED DESCRIPTION OF THE PREFERRED EMBODIMENTS

The apparatus shown in the accompanying drawings and described below are examples which embody the invention. It should be noted that the scope of the invention is defined by the accompanying claims, and not necessarily by specific features of exemplary embodiments.

Figure 1:
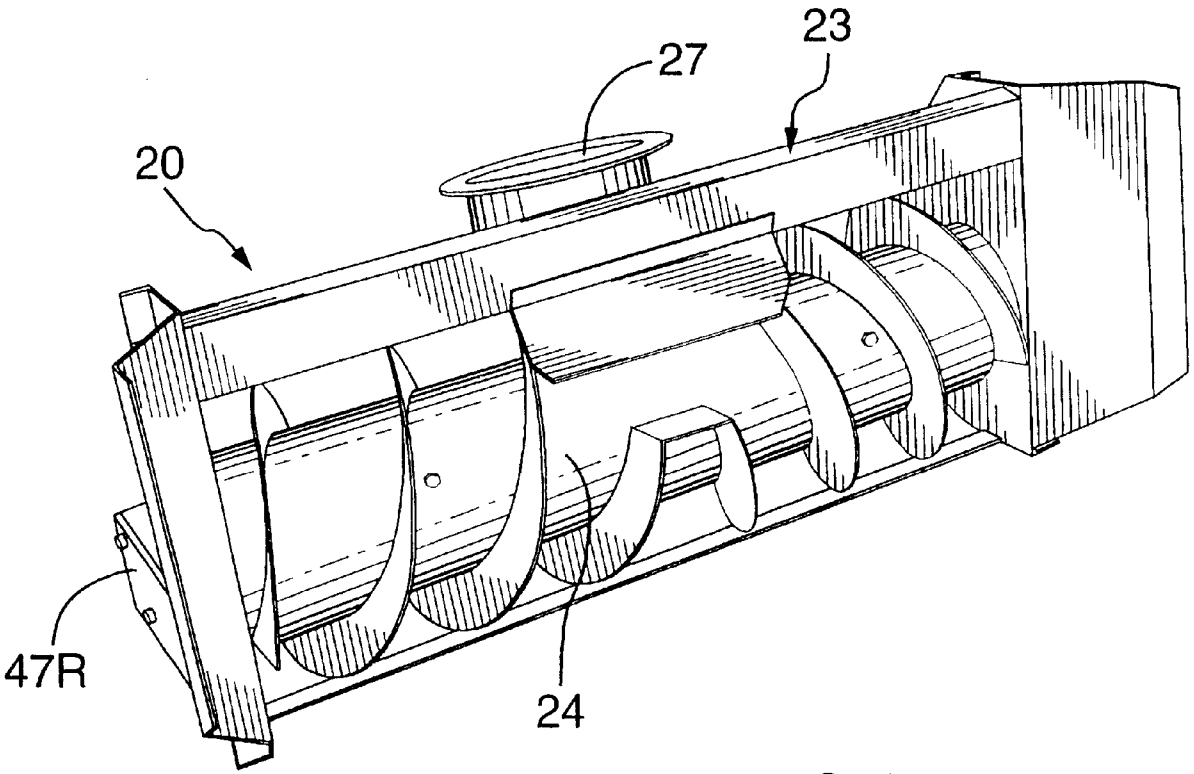
FIG. 1 is a pictorial view of a snowblower unit that embodies the invention, the unit being intended for use with an electric tractor.

FIG. 1 is a pictorial view of the snowblower unit. The unit is intended to be used with an electric tractor (not shown), of the kind which can supply power for electric accessories such as e.g grass cutters and snowblowers.

The snowblower unit 20 includes a housing or frame 23, and a rotating drum 24. The drum 24 carries a spiral blade. The spiral blade is in two sections, 25L,25R. In operation, the drum is rotated in the sense in which the front area of the drum (i.e the portion of the drum that is visible in FIG. 1) travels downwards. Thus, snow lying in the path of the advancing snowblower unit is drawn downwards into the open front of the housing 23, is drawn underneath the drum, and upwards at the rear of the drum.

At the same time, the snow is being transported towards the centre of the drum, by the action of the spiral blades 25L,25R. The snow emerges from an exit port 27. A discharge chute (not shown) can be clamped to the exit port. The discharge chute can be of conventional construction, having the facility for the operator to turn a handle, or to operate an electric rotation device, to vary the direction at which the snow emerges.

The unit as described is large, and is suitable for heavy duty usage. The drum has a length of about 100 cm, and a diameter overall of about 30 cm.

The snowblower unit 20 as shown is single-stage. Gasoline-powered snowblowers are often two-stage, in that a powered impeller is included in the exit-port, to impart extra velocity to the emerging snow, whereby the snow can be trajected a good distance away from the unit. The unit as described herein has been found satisfactory in the single-stage format, but an extra impeller in the exit port could be added, if desired.

Figure 2:
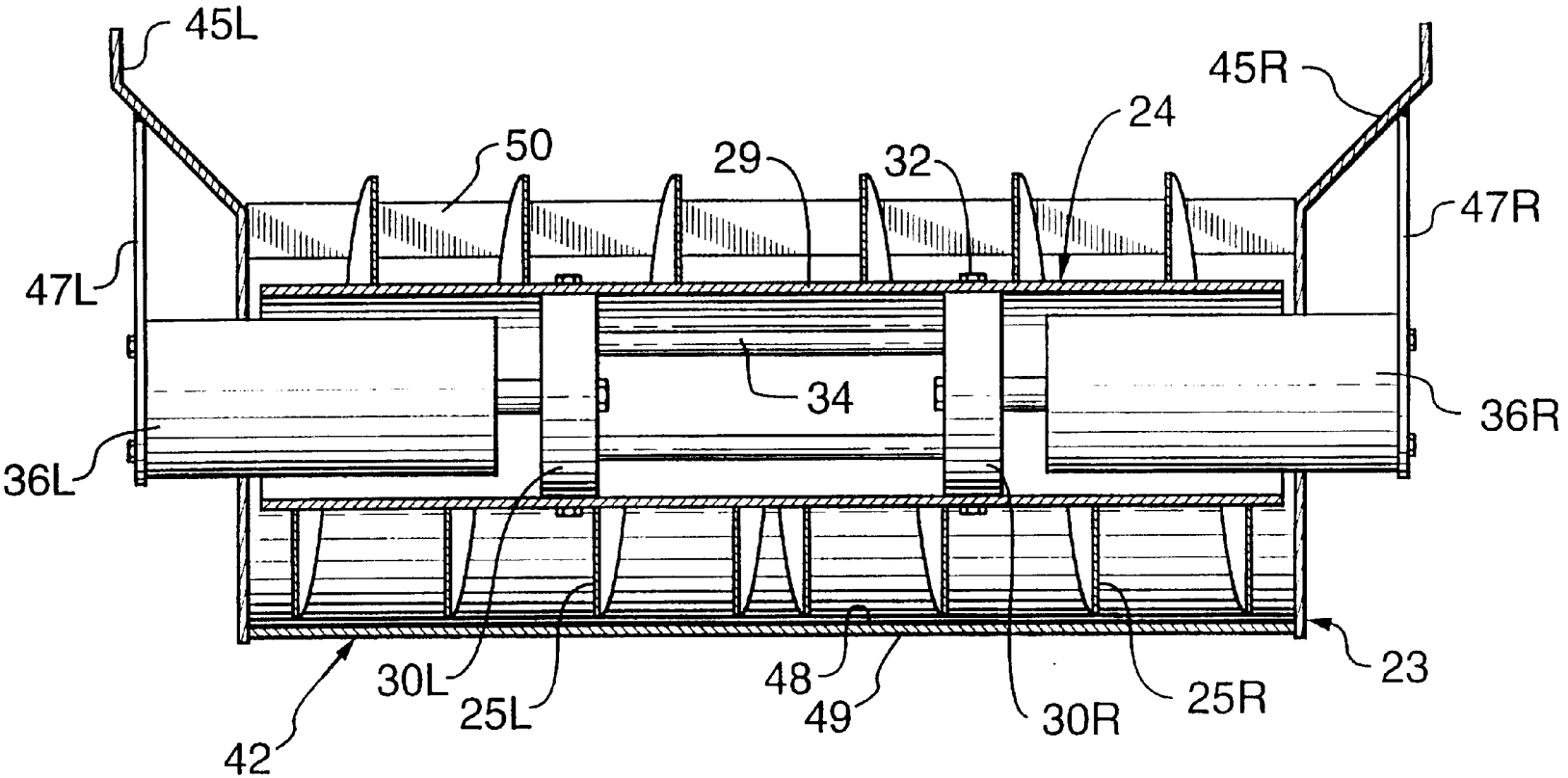
FIG. 2 is a cross-section through a rotary-drum of the snowblower of FIG. 1.

FIG. 2 shows the structure of the rotary drum 24, and shows the manner in which the drum is mounted in the frame or housing 23. The drum 24 comprises a tube 29, around which are welded the spiral blade sections 25L,25R. The tube 29 is open at each end. The tube 29 serves as the shaft, i.e the drive-shaft, of the drum. Two flanges 30L,30R lie inside the tube 29, and the tube is bolted to the flanges by means of bolts 32.

The flanges 30L,30R are fixed to each other in a spaced-apart relationship by means of (four) bars 34, which are bolted through the flanges by means of bolts 35.

Figure 3:
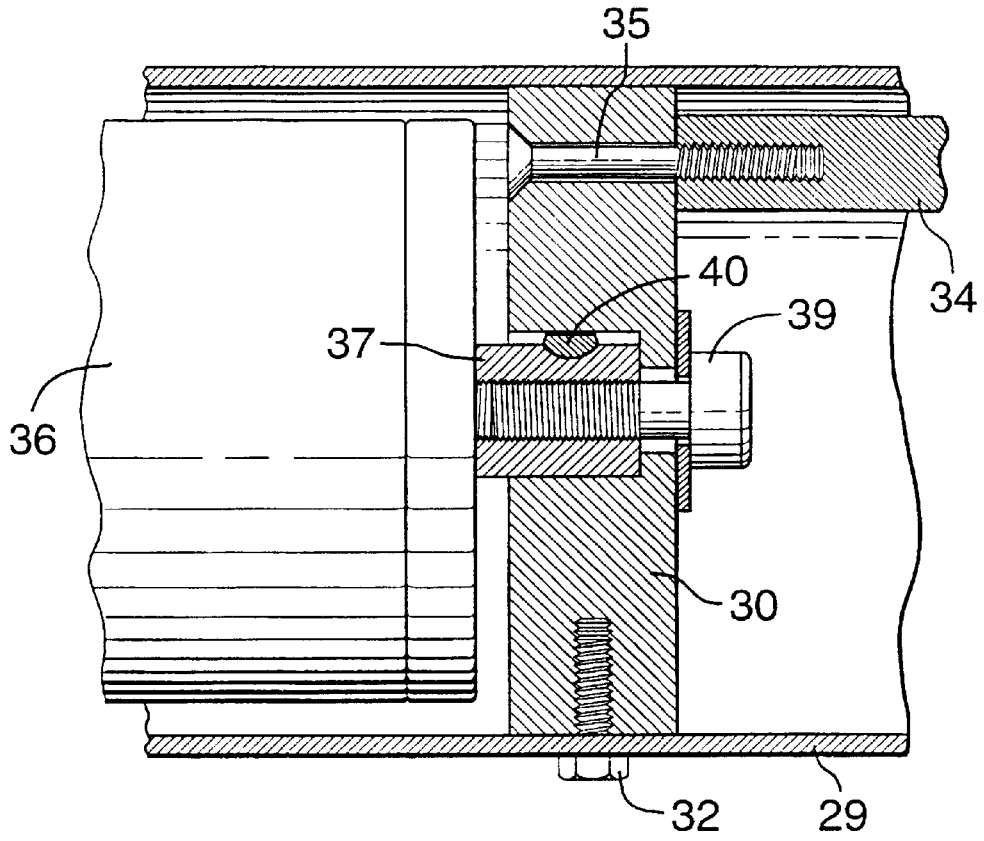
FIG. 3 is a close-up of an area of the FIG. 2 view.

The flanges 30L,30R are also attached to the shafts of two electric motors 36L,36R. The manner of attachment is shown in FIG. 3. The motor-shaft 37 is threaded internally, and a bolt 39 clamps an internal shoulder of the flange rigidly to the end of the shaft. A woodruff key 40 ensures the rotational unity of the flange and the shaft.

The motor 36 is provided internally with bearings for the shaft 37. The motor is totally enclosed, and has seals for sealing the shaft 37. It will be understood that the bearings on which the drum 24 rotates are the bearings contained within the electric motors 37L,37R.

The assembly sequence is as follows. First, the shafts of the two motors 37L,37R are secured to their respective flanges 30L,30R. Then the two flanges are secured together by means of the bars 34. The sub-assembly comprising motors, flanges, and bars is then passed inside the tube 29, and the flanges are bolted to the tube by bolts 35.

Figure 4:
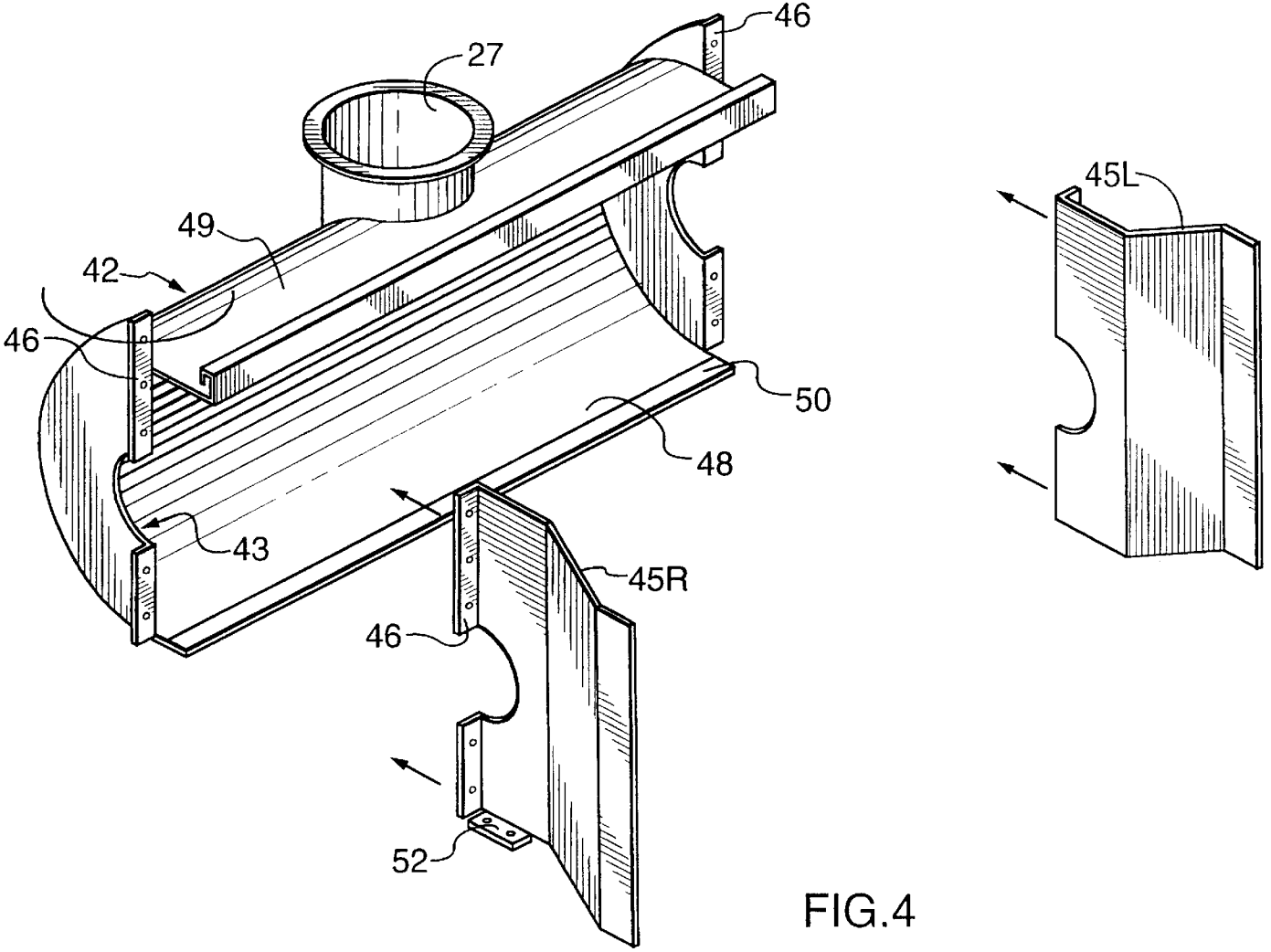
FIG. 4 is a view of the components of a housing of the snowblower of FIG. 1, shown prior to final assembly.

The sub-assembly comprising motors, flanges, bars, and the tube 29 and drum 24, is then laid on or in the back-piece 42 of the housing 23, with the left and right motor casings resting on or in the left and right semi-circular cut-outs 43 in the back-piece 42 (FIG. 4). Now, the left and right front-pieces 45L,45R of the housing 23 are placed in position, and bolted to the back-piece 42 through the side-tabs 46.

The front-pieces 45L,45R are provided with motor-location-plates 47L,47R (not shown in FIG. 4). The motor-location-plates are welded to the angled-out or lead-in areas of the front-pieces. The motor-location-plates are provided with holes whereby the plates can be bolted to the casings of the electric motors 37L,37R. it will be understood that this manner of mounting the rotary drum 24 into the housing 23 does not depend on any great degree of accuracy in the manufacture of the back-piece 42. (The back-piece 42 is of welded sheet metal construction, and so accuracy would be difficult to ensure.) If the distance between the two motor-location-plates 47L,47R, in the manufactured back-piece, should be a few millimeters different from the distance between the ends of the casings of the electric motors 37L,37R, as sub-assembled, that does not matter, in that the front pieces 45L,45R can easily distort to accommodate that difference. Such distortion, when present, has little effect on any dimension of the unit that might be regarded as critical to performance (such as the running clearance between the drum 24 and the inside face 48 of the main envelope 49 of the back-piece 42, for example).

It may be noted that the front pieces 45L,45R can easily distort, if necessary, to accommodate the drum with the motors inside. The front-pieces just bend a little to slightly open or close the mouth of the snowblower, and such distortion is immaterial, in that the running clearances and other critical dimensions are unchanged. Also, any angular mismatch or radial-displacement mismatch between the drum sub-assembly and the housing can be accommodated by such distortion. On the other hand, once the casings of the motors are bolted to the motor-location-plates, the whole structure takes on a secure, rigid, wholeness, of a kind that is suitable for a snowblower.

It will be noted that the design as described provides the resilience and flexibility needed to accommodate manufacturing inaccuracies, but at the same time provides rigidity and sturdiness for the assembled components.

Once assembled, the unit 20 may be expected to give many years of service-free operation, even bearing in mind that snowblowers are the kinds of machines that must inevitably suffer occasional accidental overloads, and abusive treatment. In this regard, the unit as described compares very favourably with a conventional gasoline-engined unit, with its chain-drives, sprockets, tensioners, drive-shafts, bearings, and paraphernalia of other stressed components, all of which have to be protected against the environment, and any of which can go wrong. It may be noted that the environment for a snowblower includes caked, salt-laden, wet snow, which can be very damaging.

The unit 20 as described herein, in contrast, does not have the problems normally associated with exposed moving parts. The shaft-bearings of the electric motors 36L,36R are vulnerable to the elements, and need to be protected, but they are buried deep inside the sealed casings of the motors; apart from them, there is really nothing else in the structure as described that could pose service-wear problems.

The main envelope 49 of the housing 23 is a sector of a right-cylinder, as can be seen from the drawings. The bottom blade 50 of the housing, which runs along in contact with the ground, needs to be of sturdy construction, but the rest of the envelope can be of fairly light construction, and can be of a plastic material, for example, although sheet metal is preferred.

Side skids (not shown) can be attached to lugs 52, to act as support runners, The skids are adjustable, and would be raised for operation over loose gravel, for example. Wheels might be provided as side-supports for the snowblower unit, if desired.

Figure 5:
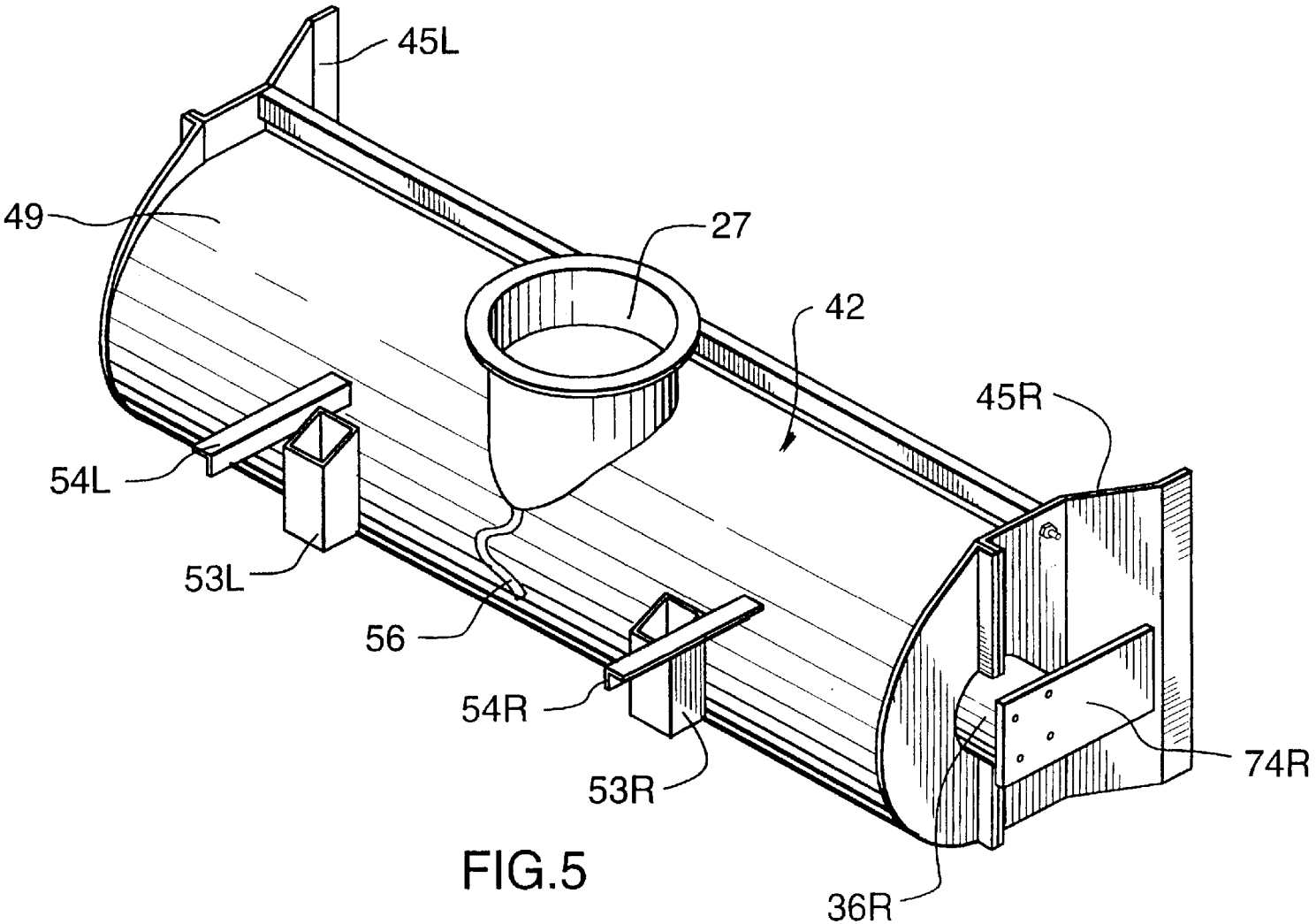
FIG. 5 is a rear view of the snowblower of FIG. 1.

The snowblower unit as described is designed to be fitted to the front of an electric tractor, preferably a tractor having a hitching system as described in the above-mentioned patent WO-94/21106, to which attention is directed. To this end, the snowblower 20 is provided with welded-on sockets 53L,53R, and guides 54L,54R (FIG. 5). A latch-bar 56 is welded to the back-piece 42 of the housing 23 of the snowblower, between the sockets. As shown in '21106, the tractor is fitted with an arm that can be raised and lowered, and the arm carries pegs.

To hitch the snowblower unit, the pegs on the arm of the tractor are lowered into the sockets 53L,53R, until a latch clicks over the latch-bar 56.

One of the distinctive advantages of the hitching system shown in '21106 is that the direction in which the pegs engage into the sockets is downwards; because of that, it is easier to hold the accessory steady during engagement, than in a case where the direction of engagement has been horizontal.

In operation, the arm of the tractor can be raised /lowered to the extent that the snowblower is pressed down onto the ground with a force that is reacted against the weight of the tractor. Alternatively, the snowblower can be carried just clear of ground.

As to the electrical details of the two motors, the designer should see to it that the electric motors in the snowblower unit are designed for a comparatively slow-speed, high-torque regime. The batteries on board the tractor make it convenient to feed the snowblower a motors with electric current at 36 volts. The range of voltages that can be made conveniently available from batteries may be regarded as 24 to 48 volts. In the unit as described, the motors are of the permanent-magnet type, and each motor has two pairs of brushes. Each motor has a length of about 25 cm long, and a diameter of about 12 cm. The motors deliver maximum power at a speed of about 850 RPM, at which the torque is in the 6 to 10 N-m range (each). 850 RPM is ideal for a single-stage snowblower having a drum of the type described. The current draw at maximum power, for the two motors, is in the 30 to 60 amps range.

Thus, the operational speed required in a snowblower, i.e several hundred RPM, is matched with the operational speed of the motor when supplied with power in the manner as noted. If, in the circumstances, the motor could only deliver power at, say, several thousand RPM, the advantage of direct drive coupling between the motor and the snowblower drum would be lost. On the other hand, gearboxes can be added to motors, and both can be integrated into a common motor+gearbox housing. In that case, the output shaft emanates from the gearbox, rather than directly from the motor, but it is still true that the bearings for the output shaft are contained within the (common) housing. It is therefore contemplated that the manner of arranging the drive components that has been described can be applied to the case where the motor is combined with a gearbox, in a common housing, i.e not only to the case where the motor is drive-coupled directly to the drum.

As mentioned, because the as-described unit has no exposed moving parts, service problems can be expected to be a minimum. But not only that: the absence of such things as chain-and-sprocket-drives, shaft-bearings, reduction-gear-boxes, and all the rest, means that many of the usual sources of inefficiency and power-loss are absent, too. All the mechanical output from the electric motors is fed straight into the snowblower drum, with very few losses, with the result that the overall power requirement is small, i.e small enough to be supplied by batteries.

It may be regarded that the principle of mounting the drum directly on the motor-shafts makes the electric-powered-snowblower a practical and economic proposition.

Figure 6:
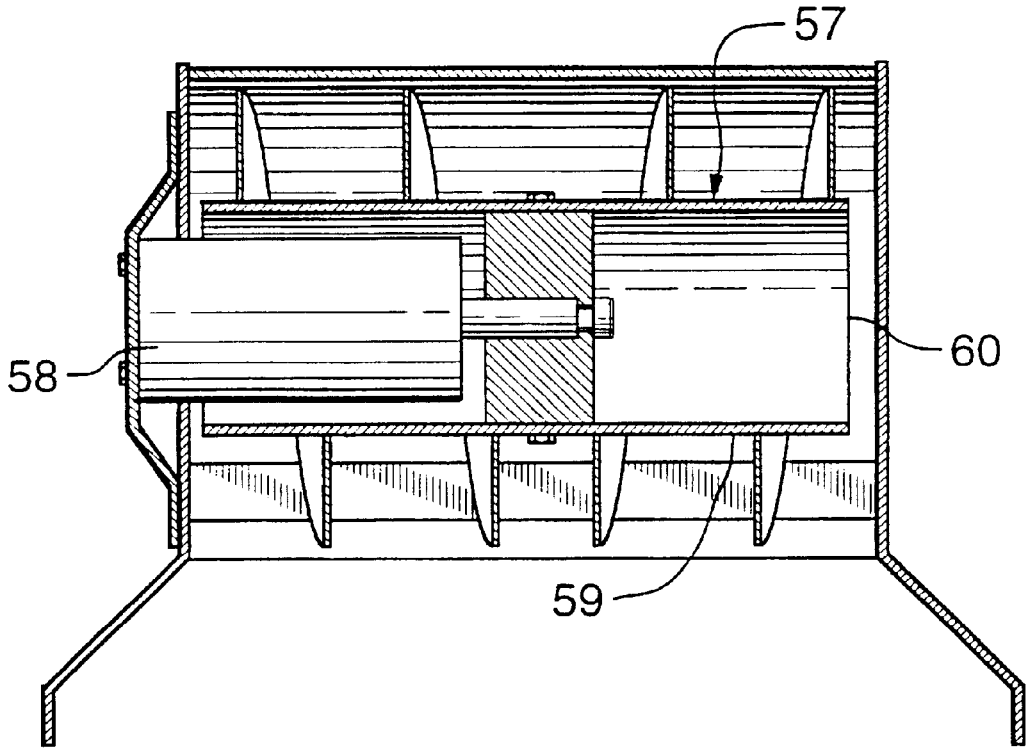
FIG. 6 is a cross-section corresponding to FIG. 2 of another snowblower.

FIG. 6 shows a snowmobile drum 57 that is driven by just one electric motor 58 at one end of the tubular drum shaft 59. The other end 60 of the drum shaft might be carried in a separate bearing mounted from the housing, but in this case the drum is carried in a cantilever-type configuration by the bearings inside the single motor 58. Of course, the single-motor configuration is not suitable when the drum has a long axial length, i.e when the snowblower is wide. Even when the drum is short, the motor-at-each-end configuration is preferred, because it leads to the drum being constrained more solidly in the housing. The drum of a snowblower has to accommodate considerable journal or radial loads, from which standpoint it will be understood that supporting the drum between two motor-bearings is better than cantilevering the drum from one motor-bearing.

Figure 7:
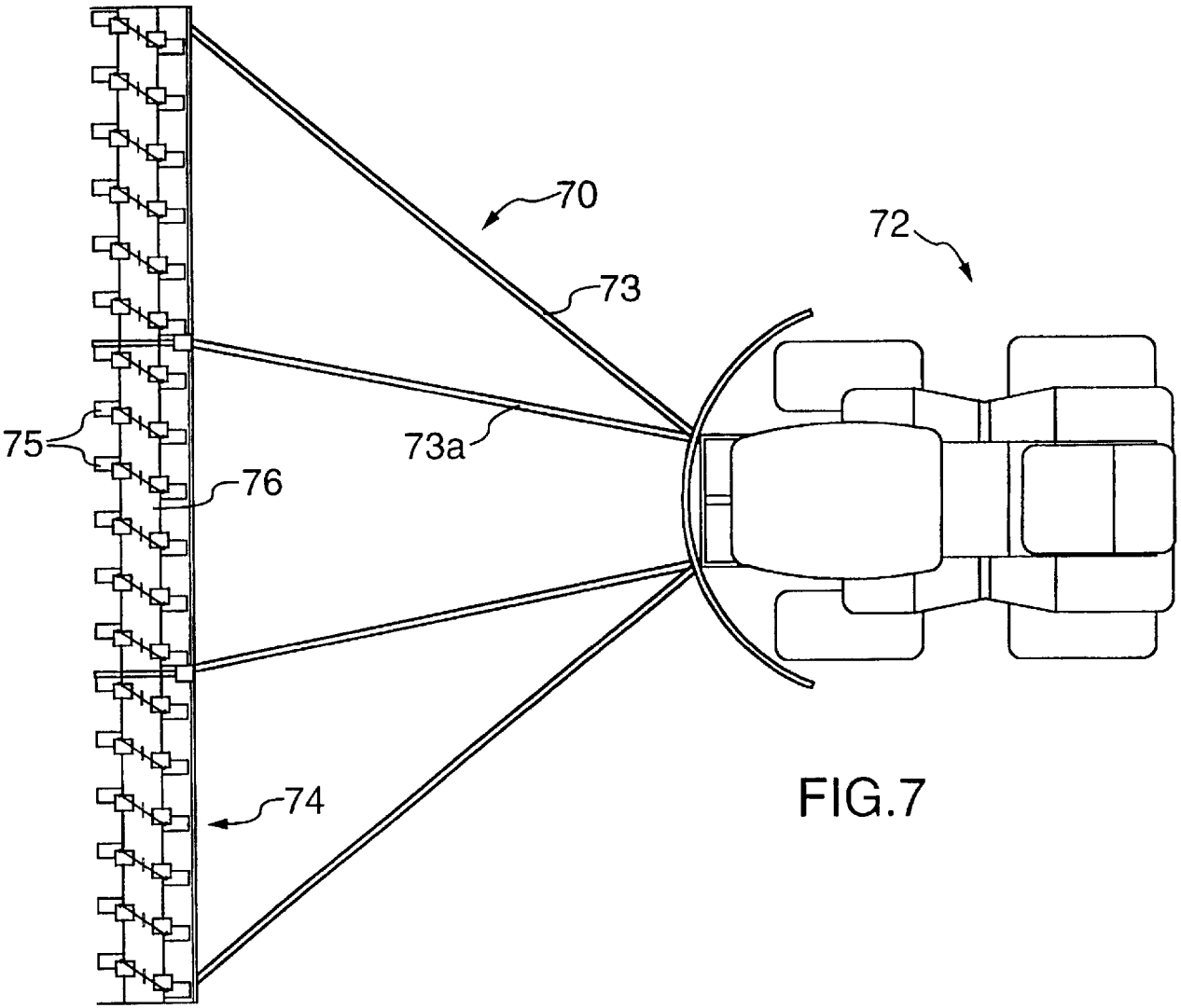
FIG. 7 is a diagrammatic plan view of an electric tractor set up in association with an apparatus for clearing landmines.

FIG. 7 shows an apparatus 70 for clearing anti-personnel land-mines. FIG. 7 shows an electric tractor 72, to the front of which are mounted forwardly-extending struts 73. The struts 73 support a flail-drum assembly 74. The assembly includes many flails, which may take the form of pieces of tire-tread 75. The pieces of tire-tread can be hooked directly onto the drum, as shown, or the pieces can be carried on chains, the inner ends of the chains being fastened to the drum 76. As the drum 76 is rotated, the tire-treads whirl around by centrifugal force, and the tire-treads pound the ground, with repeated heavy blows. If a land-mine is present, the blows cause it to explode.

The designer must see to it that the flail-drum assembly 74 survives the explosions of the land-mines.

In the flail-drum assembly 74 as illustrated, the tire-treads 75 (or flail-chains, if present) offer each only a small area to the explosive forces, whereby the explosive forces pass around and through those components. The explosion causes the chains and treads to fly about, but this gives rise merely to a momentary stress at a low enough level that the components are not damaged, The energy of the explosion goes into flinging the chains and treads vigorously upwards; but there are many of them, and the force experienced by any one flail is not enough to damage it.

The drum 76 survives the explosion, not because the drum is open in its structure, but because the drum is cylindrical, which is an inherently strong and rigid configuration. It takes a large explosion indeed to bend, or even to dent, the walls of a sturdily-designed cylindrical drum.

Figure 8:
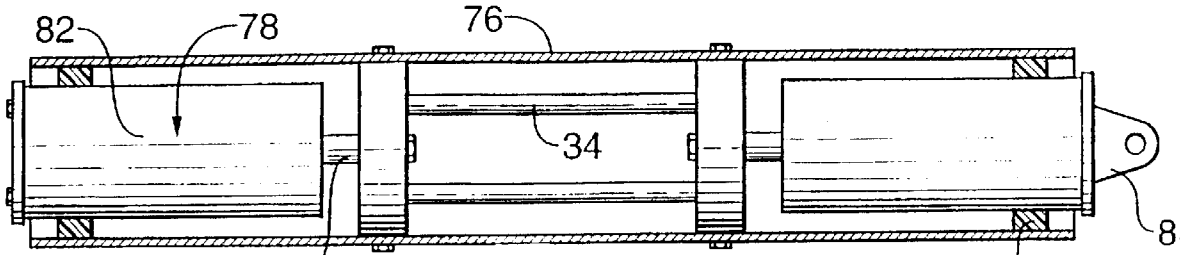
FIG. 8 is a cross-section of a flail-drum of the apparatus of FIG. 7.
Figure 9:
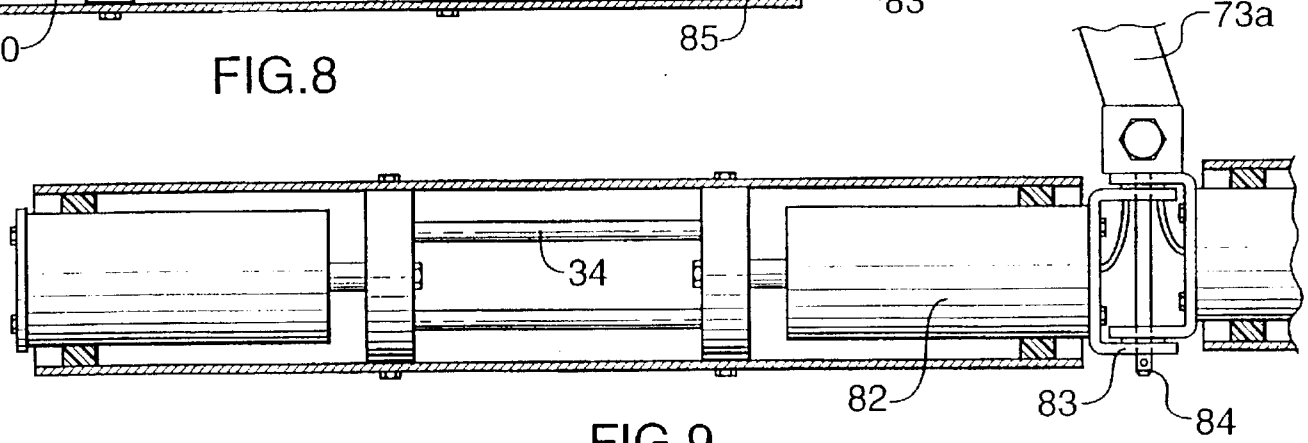
FIG. 9 is the same view as FIG. 8, but shows two drums mounted to a strut.

The drum 76 is driven into rotation by an electric motor, or in this case by two motors 78 (FIG. 8). The motors are carried inside the cylindrical drum 76. The motors 78, which of course might be susceptible to being damaged if they were exposed to the direct force of the explosion, lie protected inside the sturdy cylindrical drum 76. The motors are mounted directly inside the drum, and there are no drive shafts or other rotating mechanical components needed to connect the tractor to the flail-drum assembly. Only an electric cable connection 79 is required. To protect the cable 79, the strut 73 can be made hollow, and the cable passed inside (FIG. 9).

Figure 10:
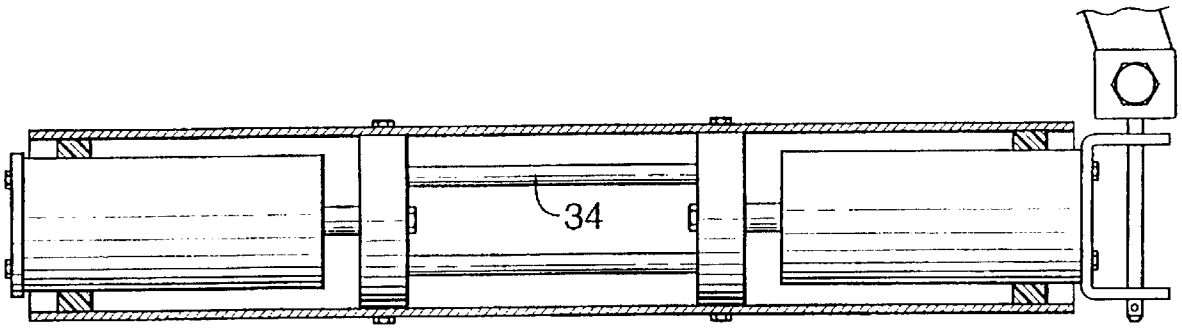
FIG. 10 is the same view as FIG. 8, but shows the manner of coupling the drum.

The drum 76 rotates in unison with the shafts 80 of the motors 78. Access, therefore, to the motor housings 82, for the purpose of mounting the motors, and of reacting the rotational torques generated by the motors, is obtained at the axial ends of the drum 76. As shown in FIG. 10, each housing 82 carried a stirrup 83. A pin 84, which is carried by the strut 73, engages the stirrup as shown. Each flail-drum assembly 74 is attached to respective struts 73 at its two axial ends. The intermediate struts 73A each serve two flail-drum assemblies, as shown in FIG. 9.

Mounted thus, the motor housing 82 is constrained against all modes of movement relative to the strut other than rotation about the pin 84. The pin is so aligned that this movement takes place about a roll-axis. Therefore, the separate flail-drum assemblies can each lie at different roll-angles relative to each other (FIG. 11), whereby the flail-drums are able to conform to the contours of the ground.

This ability to conform to the ground is important. In general, flail systems for exploding land mines are known to be effective over flat, level ground, but the reliability notoriously falls off if the ground is uneven. It should be noted that a system for exploding mines that leaves even just an occasional mine unexploded is very much non-preferred. To make a land area usable again, it is the fear of land-mines that has to be eliminated, and that does not happen if the clearing agency has to report that there might be a few left. (In many industrial circumstances, a machine that has 100% perfect performance is only marginally better than a machine with 99% performance; but in mine-clearing, it is largely a case of perfection or nothing. However, of course, nothing can be truly 100% effective.)

It may be noted that the standard of perfection of mine-clearing that will allow military operations to resume is lower than the standard that will allow agriculture to resume. However, the budget available for clearing to enable resumption of agriculture is often tiny compared with the military budget. Also, often, the military objective is just to clear a fairly narrow path through a mine-field, to establish a thoroughfare. Clearing all the mines out of large areas, to permit agriculture, is not normally done by the military.

An aim of the present system is to enable mine-clearing in the range of kinds of ground from flat to as uneven as is likely to be encountered in land that is suitable for agriculture, or habitation. In the past, one of the major problems in mine-clearing technology has been with land that is not flat enough to be cleared by conventional flail systems, and other traditional mine-clearing systems, but yet the land is otherwise practically suitable for agriculture.

Figure 11:
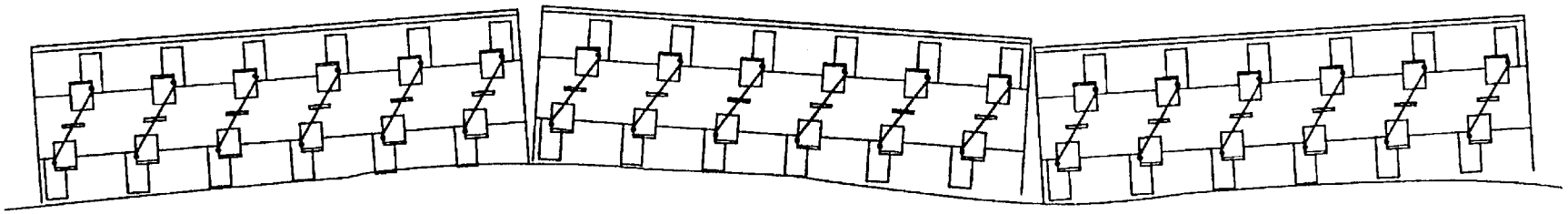
FIG. 11 is a front view of the apparatus, shown passing over uneven ground.

The device as described is for flailing agricultural fields, and other areas which formerly were inhabitable, but are no longer so because of the feared presence of land mines. The high performance of the device in that context arises mainly because the flail-drums are able to conform closely to the ground. The flail-drums can do this because the drums are mounted on struts which extend a considerable distance in front of the tractor, and so the drums are able to rest on the ground without constraint from the tractor. Also, conformability is improved by the fact that the drums are each short, and are able each to adopt its own roll-axis (FIG. 11).

Figure 13:
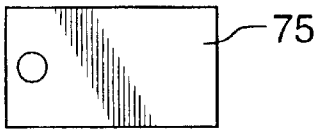
FIG. 13 is a view of one of several tire-tread-pieces carried on the flail drum.
Figure 12:
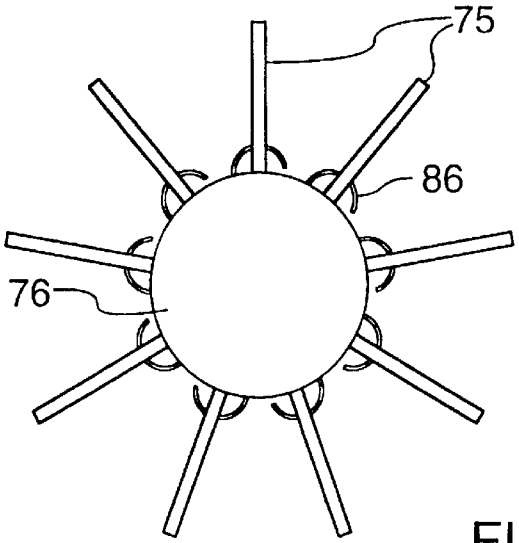
FIG. 12 is a side-view of the flail-drum.
Figure 12A:
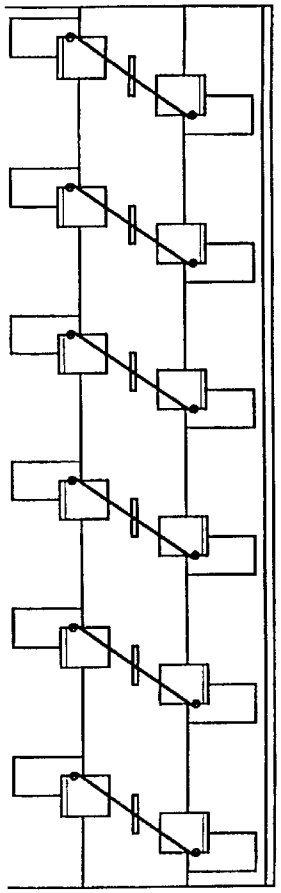

FIG. 12 shows the drum 76, and the pieces of tire tread 75 attached to hooks 86 on the drum. FIG. 13 shows one of the pieces 75. FIG. 7 also illustrates the fact that the pieces 75 are staggered along the length of the drum, so that no portion of the ground surface is missed.

As shown, adjacent drums share a strut, which means the ends of adjacent struts are constrained to be at the same height. For a little extra conformability, the drums can be provided each with its own two respective struts, one at each end.

It should be noted that the excellent conformability, as described, is achieved even though the area swept by the device in one pass is several meters wide. (The device might, however, be used with just one drum—in confined spaces between trees, for example.)

It may be noted that there is no need for a fixed structure straddling the two ends of the drum 76. The motors 78 are mechanically stabilised inside the (rotating) drum by Teflon supports 85. These supports are not bearings, but rather the supports 85 are there to limit deflection of the motor 78, relative to the drum 76, during explosions.

When conventional flail-drums have been driven from the vehicle, by means of a mechanical drive shaft (or chain drive, etc) from a power-take-off on the vehicle, the distance the flail-drum could lie ahead of the vehicle was strictly limited. Even so, the vehicle had to be heavy, to keep the flail-drum stable. In the present design, the flail supports itself on the ground, i.e supports its own weight; also, the flail unit is self-driven, and so only an electric cable is needed from the vehicle to power the drum. The struts do not support the weight of the flail drum, from the tractor, and the struts do not carry any drive shafts or the like from the tractor to the flail-drum. Therefore, the struts 73 can be of the required slender profile needed for surviving explosions, but furthermore, the struts can be several meters long. This allows the operator to be positioned well back, so that even if several mines might be booby-trapped to go off together when one is triggered, the operator (and the tractor) come to no harm. Actually, the tractor can be remote-controlled, whereby the operator can be even further away from the potential explosions.

Figure 14:
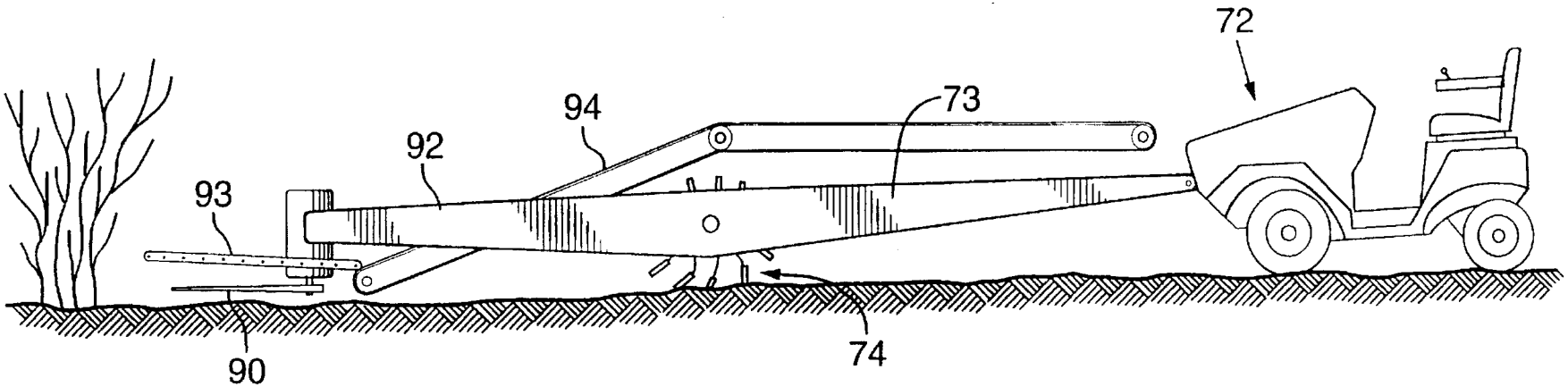
FIG. 14 is a diagrammatic side-view of a mine-clearing train.

One of the problems with land-mine clearing is the fact that the area to be cleared might be overgrown with dense bush (because nobody has ventured into the area to clear the undergrowth, nor for any other purpose, since the mines were laid). Such undergrowth might need to be cut away in order for the flailing system to achieve proper performance. An undergrowth cutter unit can in that case be provided. The undergrowth cutter is mounted ahead of the flail-drum, so that the flail-drum pounds onto ground that has just been cleared of undergrowth. Preferably, the undergrowth cutter should have a blade that applies a scythe motion to the undergrowth. The scythe blades should be mounted for spinning about a vertical (yaw) axis, i.e the blades spin in a horizontal plane, In FIG. 14, the undergrowth cutter 90 is held clear of the ground by forward extensions 92 to the struts 73. The weight of the undergrowth cutter (and of other in-front attachments, if any) is easily carried by the struts, and the weight of the tractor holds the back ends of the struts down. (The weight of the tractor can hold the back end of the strut down, and the attachment up, even though the tractor is light, because the strut is long.)

The undergrowth cutter should itself be designed to survive explosions, given that the disruption of the undergrowth might explode the mines. Fallen cut undergrowth would itself impede the flailing action, and so the apparatus should preferably include a means for removing the cut undergrowth. This comprises an undergrowth collector tray 93. A conveyor means 94 is provided for conveying the cut pieces back, towards the tractor, where the pieces can be disposed of.

The conveyor 94 can be positioned on top of the struts 73, and the weight of the conveyor, and the weight of the materials being conveyed thereon, are supported by the struts. That extra weight of course is transferred to the flail-drums (but, if anything, that is advantageous).

Means might be provided ahead of the undergrowth cutter, to burn off at least some of the undergrowth. However, in many cases it would be more appropriate to conduct a general burn of undergrowth over the whole danger area, ahead of going in with the mine-clearing apparatus.

Whether or not a forward burner is provided, it is apparent that the apparatus as described is suitable for creating a (slow-moving) train of appliances, all pushed along by the tractor, via the struts. The weights of some of the appliances can be transferred to and supported by the flail-drums, as required. This ability to create a train of different appliances is important, because it (potentially) allows the mine-clearing activity to be accomplished in a single pass. A mine-clearing system that requires more than one pass requires the operators to enter an area that has not been completely cleared. That is so unsatisfactory as to be more or less pointless. Even a system which separates a detection-plus-mark stage, followed later by a detonation stage, is, by comparison, highly unsatisfactory.

Again, it is emphasized that the system as described offers the potential of clearing anti-personnel land-mines, and leaving the area suitable for agriculture, in a single pass. (A single pass, that is to say, apart from an initial pre-burn of undergrowth. The aim is for single-pass in the sense that once the operators start a pass into the area with the apparatus, they must leave the area 100% cleared, and ready for use, behind the apparatus.)

The appliances that might be entered as elements on the train include, for example (in a order): 1. undergrowth cutter and collector; 2. flail; 3. shallow plow; 4. another flail; 5. deeper plow or till. There is no mechanical drive connection to any of the appliances, in that each can be powered by its own motors. The designer should seek to have each appliance other than the flails held clear of the ground, especially those appliances forward of the flails, so that these appliances are subjected only very occasionally to explosions, since these other appliances are more difficult to design to survive explosions.

It can be difficult to cope with roots that have grown over the mines, under the surface of the soil. The problem with roots is that heavy flailing might fail to detonate the mine, but even just slightly disturbing the root later might detonate it. That is why it is important to include a plowing or tilling operation in the single pass, and indeed to ensure that the plowing or tilling operation goes as deep as (or deeper than) the farmer is likely to go in subsequent agricultural operations. The system as described offers the potential for achieving a single-pass system, even in that context.

The flail-drum and other appliances are intended to rotate constantly during operations, and operations might last for several hours at a time. The power is supplied from a power supply (batteries) in the electric tractor, which must be designed to accommodate this usage. The tractor itself does not take much power, since it is only moving at walking pace, or less, during operations.

Some further points about the snowblower appliance may be made, as follows. The principle of mounting the drum directly on the motor-shafts can be applied even when the snowblower unit is not hitched to a tractor, but, for example, rests on the ground and is pushed along by a person. The electric power in that case can be supplied from batteries carried on the snowblower unit. (Snowblowers in the push-behind configuration are generally considerably narrower than 100 cm, and require less power.)

In a case where the motors of the snowblower unit are fed from the 110-volt mains, by means of an extension cord, again the designer should aim for an operational speed of about 850 RPM for the drum (and therefore also for the electric motors). It is recognised that a current draw of about 12 amps at mains voltage is all that is needed, and that is within the range of practicality.

Figure 15:
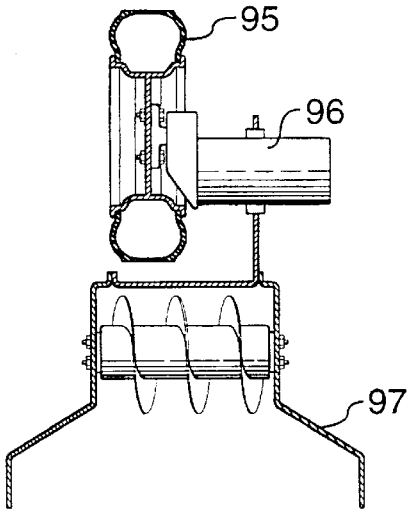
FIGS. 15–17 are diagrammatic plan views showing different walk-behind versions of the snowblower appliance.
Figure 16:
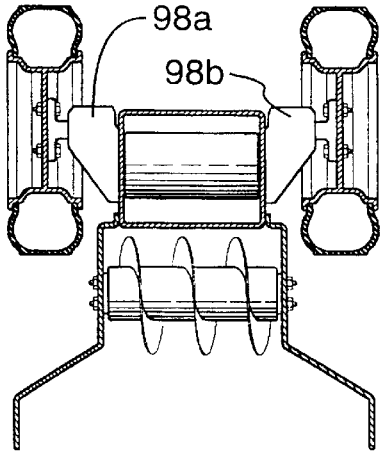
Figure 17:
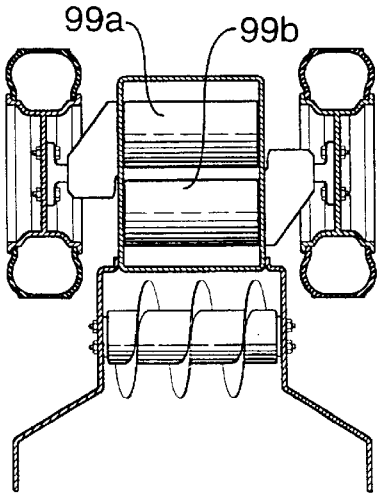

FIGS. 15–17 show versions of the snowblower appliance, in which the appliance is not carried as an accessory on a tractor, but is operated by an operator on a walk-behind basis. Here, wheels (or tracks) support the weight of the appliance. In addition to the drum being motor-driven, the wheels of the appliances are also motor-driven along the ground, by electric motors. The different ways in which the wheel-motors are arranged will now be described.

In FIG. 15, only one road wheel 95 is provided. The wheel-motor 96, and associated gearbox, are coupled directly to the wheel, and the wheel has no other bearings, other than the bearings contained in the motor/gearbox. However, the designer might elect to provide a bearing on a wheel-shaft extension lying to the left of the wheel in FIG. 15. The motor/gearbox housing is an integrated unitary structure, which is attached to the frame 97 of the snowblower.

The appliance shown in FIG. 16 has two road wheels. Here, two gearboxes 98*a*,98*b* are provided, one at each end of the motor. The road wheels have no bearings other than the bearings on the output shafts of the gearboxes. The motor and two gearboxes share a common housing, which is attached to the frame.

In FIG. 17, the two road wheels have individual motor/gearboxes, each with its own separate housing 99*a*,99*b*. The axes of the motors are offset so that the axes of the wheels can be co-axial. It is noted that this arrangement allows two relatively long motors to be accommodated side by side in a relatively narrow chassis. The motors can be arranged one above the other, or one behind the other.

It is noted that sophisticated detectors are available that can sense the difference between a mine and e.g a rock, as much as 30 cm below the ground surface. The train as described can include as one of the later appliances therein a scanning and detecting station, preferably following the flails and plows.

Figure 18:
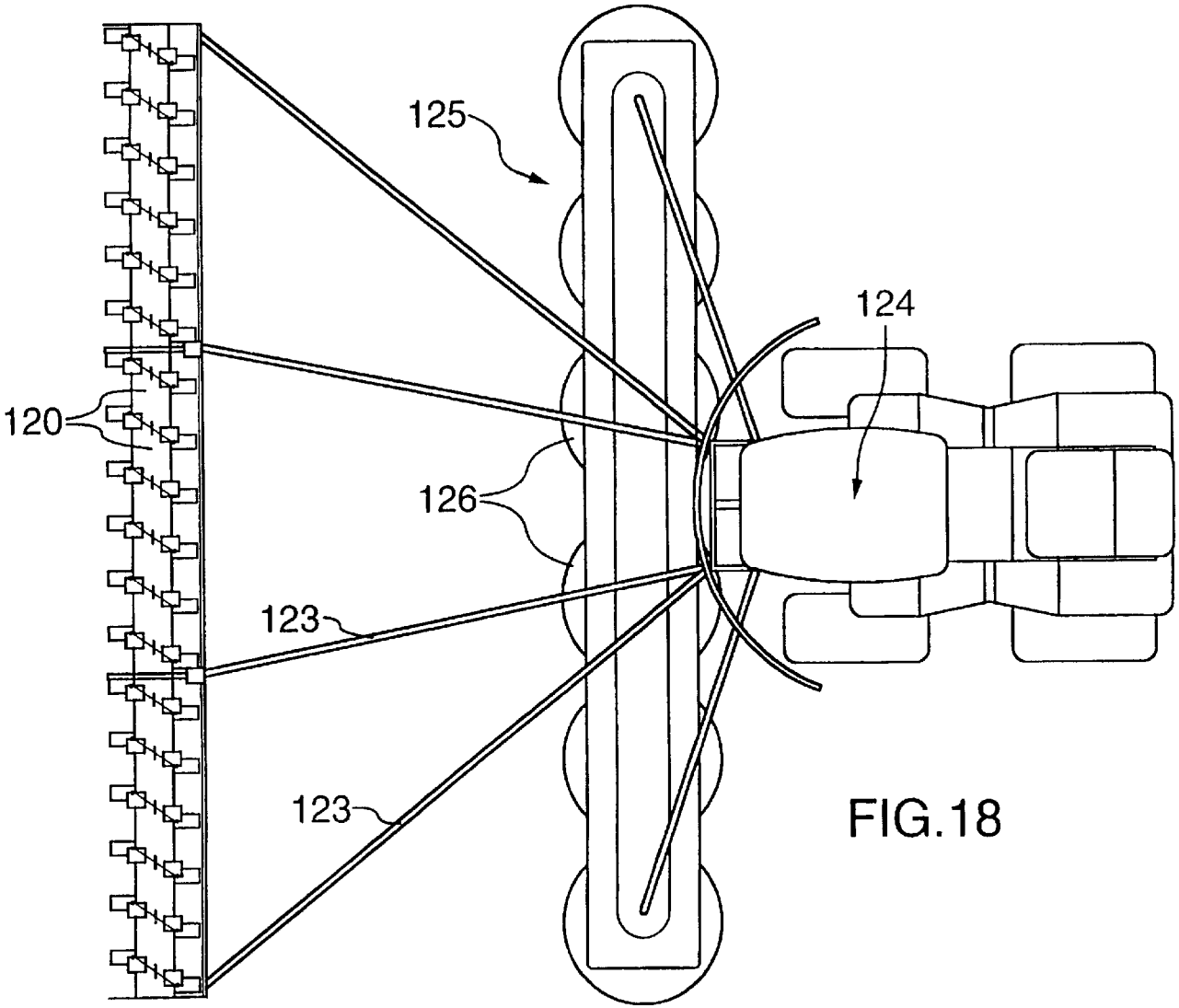
FIGS. 18, 19 are diagrammatic plan views of mine-clearing systems, showing the use of scanning detectors.

In FIG. 18, flail-drums 120 of a mine-clearing train are shown, being pushed along by struts 123 coupled to the tractor 124, in the manner as previously described. Again, the flail-drums 120 rest their own weight on the ground; i.e the struts do not support the weight of the flail-drums. Also included in the train is a buried-mine detector unit 125. This unit includes a number (six are shown) of sophisticated detection probes or scanners 126.

Figure 19:
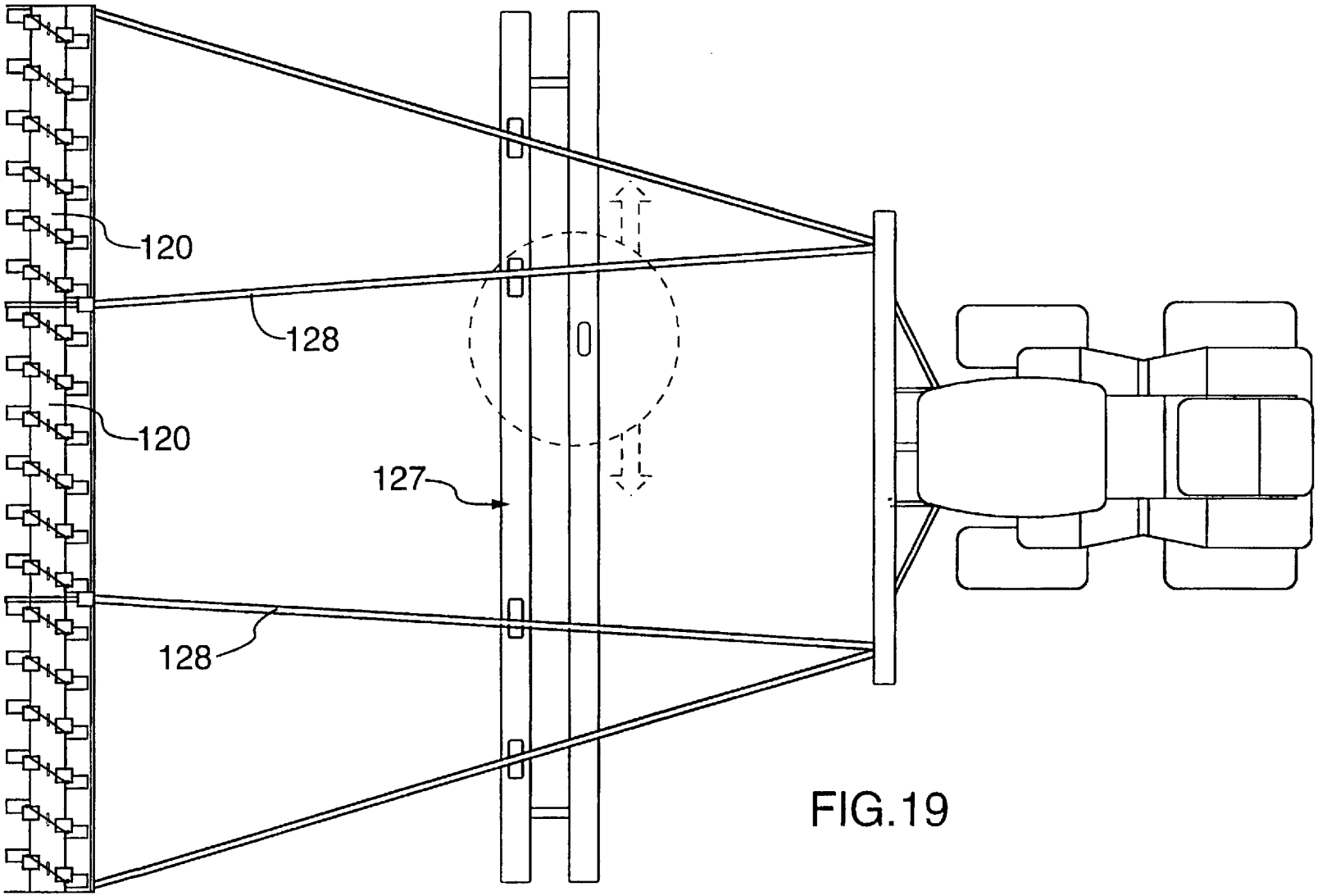

In FIG. 19, the detector unit 127 rests on the struts 128, clear of the ground. The front ends of the struts are carried by the flail-drums 120, and the rear ends of the struts are carried by the tractor. Setting the detector unit 127 some way ahead of the tractor, as in FIG. 19, means that if a detonation should occur, the tractor is less likely to be damaged. If the ground is not level, however, the detector probably should be carried at the tractor, as in FIG. 18, where the height above the ground is maintained more nearly constant, since the height can be critical to the performance of the detector.

A detonation unit should be provided in association with the detector unit, so that if a buried mine is detected, a probe or other means can be driven down to the mine, there and then, to detonate it. Insofar as other means for rendering the detected mine harmless are available, other than detonation, those could be substituted in place of detonation. Again, however, the concept of marking the area of a detected mine for subsequent detonation or other treatment is hardly to be countenanced.

What is claimed is:

1. Rotary drive apparatus, wherein:

the apparatus includes left and right motors, the motors being spaced-apart, physically separate structures, arranged co-axially;

in respect of each of the left and right motors, the motor includes a rotary shaft, and includes a non-rotary casing, fixedly mounted in a frame of the apparatus, which surrounds the shaft in a radial sense, and from which the shaft protrudes in an axial sense;

the apparatus includes a rotary drum, of a tubular form, having a hollow interior;

in respect of each of the left and right motors, at least a portion of the casing lies contained inside the hollow interior of the drum, in the radial sense;

in respect of each of the left and right motors, at least a portion of the casing lies contained inside the hollow interior of the drum, in the axial sense;

the apparatus includes a functional rotary element carried on the outside of the drum;

the functional rotary element is adapted for performing a purposeful, forceful, manipulative operation upon a surface situated outside and alongside the drum;

in respect of each of the left and right motors, the motor includes shaft-bearings, which guide and support the shaft for rotation relative to the casing;

in respect of each of the left and right motors, the shaft-bearings of the motor are housed and contained within the casing of the motor;

the apparatus includes a coupling means;

the arrangement of the apparatus is such that the coupling means is effective to drive-couple the rotary drum directly to the shaft of the right motor and directly to the shaft of the left motor;

the arrangement of the apparatus is such that the drum is guided and supported for rotation by and between the shaft-bearings of the left and right motors;

the arrangement of the apparatus is such that the drum is free of, in the sense of being mechanically unconstrained by, any means for rotationally guiding and supporting the drum, other than the said shaft-bearings which are contained in the casings of the left and right motors.

2. As in claim 1, wherein the coupling means is of such rigid structure that a sub-assembly comprising the left and right motor shafts, the coupling means, and the drum, comprises a structurally-rigid rotary unit.

3. As in claim 2, wherein the apparatus includes left and right motor-location arms, which connect the left and right motor casings to the frame of the apparatus.

4. As in claim 3, wherein:

this apparatus includes a tractor, and the motor-location arms are in the form of connecting struts, which connect the frame of the apparatus to the tractor;

the connecting struts are arranged so as substantially not to transmit the weight of the drum and of the motors inside the drum to the tractor, whereby the drum rests on the ground under its own weight.

5. As in claim 4, wherein the apparatus includes a tractor, the motors are electric motors, the tractor carries batteries, cables convey power from the batteries to the motors, and the cables are protected from damage by being housed in the struts.

6. As in claim 4, wherein the apparatus includes a plurality of drums, arranged in line across the front of the tractor and includes a corresponding plurality of struts, which are so arranged as to permit each drum to adopt its own angle upon the ground.

7. As in claim 4, wherein:

the apparatus comprises an anti-personnel-land-mine clearing apparatus;

the functional rotary structure includes flails mounted on the outside of the drum, which extend radially by centrifugal force when the drum is rotated.

8. As in claim 7, wherein the said drum with flails mounted thereon is but one appliance of a train of powered appliances, comprising at least one other appliance, disposed in sequence one behind the other, all the appliances being driven over the ground by struts extending forwards from the tractor.

9. As in claim 8, wherein the struts are arranged so that weight of the said other appliance is transmitted via the struts to the flail-drums, to the extent that the appliance can move over the ground without touching the ground.

10. As in claim 9, wherein the other appliance is an undergrowth cutters positioned ahead of the drum with flails.

11. As in claim 9, wherein the apparatus includes a further appliance, comprising a means for engaging and turning the soil, positioned in sequence after the drum with flails, the struts being so arranged as to allow the further appliance to apply its own weight onto the ground.

12. As in claim 1, wherein:

the apparatus is configured as a walk-behind unit, having a first ground-engaging wheel for supporting the weight thereof;

the apparatus includes a first travel-motor, for driving the wheel, and thereby for causing the apparatus to travel over the ground;

the left and right motors, and the first travel-motor, derive power from batteries carried on board the apparatus.

13. As in claim 12 wherein:

the first travel-motor is included in a travel-motor-unit, arranged in a housing, having a drive-shaft protruding from the housing, the drive-shaft being supported in bearings inside the housing;

the first wheel is mounted on the drive-shaft, and the wheel has no bearings other than the said bearings inside the housing.

14. As in claim 12, wherein:

the apparatus includes a second ground-engaging wheel, co-axial with the first;

the first travel-motor and a first gearbox unit are arranged in a first unitary common housing, having a first wheel-shaft protruding from the housing, the wheel-shaft being supported in bearings inside the housing;

the apparatus includes a second travel-motor and second gearbox unit, arranged in a second unitary common housing, having a second wheel-shaft protruding from the housing, the wheel-shaft being supported in bearings inside the housing;

the ground-engaging wheels are mounted respectively on the first and second wheel-shafts, and the wheels have no bearings other than the said bearings inside the housings.

15. As in claim 14, wherein:

the first common housing includes a cylindrical portion which encases the first travel-motor, and which is offset from the first wheel-shaft;

the second common housing includes a cylindrical portion which encases the second travel-motor, and which is offset from the second drive-shaft;

the cylindrical portions are arranged in overlying offset side-by-side relationship, the first and second wheel-shafts being co-axial.

16. As in claim 12, wherein:

this apparatus includes a second ground-engaging wheel, co-axial with the first;

the first travel-motor and a gearbox unit are arranged in a unitary common housing, having left and right wheel-shafts protruding from opposite ends of the housing, the wheel-shafts being supported in bearings inside the housing;

the first and second wheels are mounted respectively on the left and right wheel-shafts, and the wheels have no bearings other than the said bearings inside the housings.

17. As in claim 1 wherein the functional rotary element makes brushing contact with the ground.

18. As in claim 1, wherein:

the shafts of the left and right motors carry respective left and right flanges, and the arrangement of the apparatus is such that the left and right flanges lie in a spaced-apart configuration;

the apparatus includes rigid bars, which straddle between the left and right flanges;

the structure of the flanges and of the rigid bars is such that a sub-assembly comprising the left and right motor shafts, the left and right flanges, and the rigid connecting bars, comprises a structurally-rigid rotary unit.

19. As in claim 1, wherein the apparatus comprises a snowblower, and the functional rotary structure includes a snow trajecting blade, mounted on the outside of the drum.

20. As in claim 19, wherein:

a non-rotary housing of the snowblower comprises a back piece and a front piece, which are secured together at a split-line;

the split-line passes through the axes of the left and right motors;

the housing is of such shape and dimensions as to accommodate and support the casings of the motors between the back piece and the front piece.

21. Rotary drive apparatus, wherein:

the apparatus includes a prime-mover;

the prime-mover includes a shaft, and includes a casing, which surrounds the shaft in a radial sense, and from which the shaft protrudes in an axial sense;

the prime-mover comprises a rotor and stator and one of either the shaft or the casing comprises the rotor, and the other comprises the stator;

the apparatus includes a rotary drum, of a tubular form, having a hollow interior;

at least a portion of the casing lies contained inside the hollow interior of the drum, in the radial sense;

at least a portion of the casing lies contained inside the hollow interior of the drum, in the axial sense;

the apparatus includes a coupling means which is effective to drive-couple the rotor of the prime-mover directly to the rotary drum;

the apparatus includes a functional rotary element carried on the outside of the drum;

the functional rotary element is adapted for performing a purposeful, forceful, maniplative operation upon a surface situated outside and alongside the drum;

the prime-mover includes rotor-bearings, which guide and support the rotor for rotation relative to the stator;

the rotor-bearings are housed and contained within the casing of the prime-mover the coupling means includes a fixed, rigid, mechanical connection between the rotor and the drum;

whereby the drum also is guided and supported for rotation by the rotor-bearings;

the drum is free of, in the sense of being mechanically unconstrained by, any means for guiding and supporting the drum, other than the said rotor-bearings, contained in the casing of the prime-mover.

22. As in claim 21, wherein the drum has substantial axial length, and the functional rotary structure is disposed and distributed along the length of the outside of the drum.

23. As in claim 21, wherein the coupling means between the rotor and the drum is located inside the hollow interior of the drum.

24. As in claim 21, wherein the motor is totally enclosed by the casing, and the shaft is sealed into the casing.

25. As in claim 12, wherein the prime-mover is a single motor;

the single motor includes a rotary shaft, and includes a non-rotary casing which is fixedly mounted in a frame of the apparatus;

the rotary shaft is carried in shaft-bearings that lie housed within the casing; the rigid coupling means is effective to support the drum, cantilever-fashion, from the shaft of the single motor;

the arrangement of the apparatus is such that the drum is free of, in the sense of being mechanically unconstrained by, any means for rotationally guiding and supporting the drum, other than the said shaft-bearings which are contained in the casing of the single motor.

26. As in claim 12, wherein the prime-mover is a motor, having a shaft and a casing;

the shaft is carried in shaft-bearings that lie housed within the casing;

the arrangement of the apparatus is such that the motor casing is able to rotate, and the motor shaft is fixedly mounted, against rotation, in a frame of the apparatus;

and the coupling means is effective to coupled the drum directly to the casing.

* * * * *